US012808144B2

(12) United States Patent
Simon et al.

(10) Patent No.: US 12,808,144 B2
(45) Date of Patent: Nov. 24, 2026

(54) BOX BLADE

(71) Applicant: Deere & Company, Moline, IL (US)

(72) Inventors: Mark A. Simon, Dubuque, IA (US); Arun Narayanan, Pune (IN); Nicholas J. Rokusek, Dubuque, IA (US); Brett S. Graham, Dubuque, IA (US)

(73) Assignee: Deere & Company, Moline, IL (US)

( * ) Notice: Subject to any disclaimer, the term of this patent is extended or adjusted under 35 U.S.C. 154(b) by 635 days.

(21) Appl. No.: 18/455,827

(22) Filed: Aug. 25, 2023

(65) Prior Publication Data

US 2025/0067019 A1 Feb. 27, 2025

(51) Int. Cl.
*E02F 3/76* (2006.01)

(52) U.S. Cl.
CPC ..... *E02F 3/7613* (2013.01)

(58) Field of Classification Search
CPC ..... E02F 3/7618; E02F 3/7631; E02F 3/7663; E02F 3/34; E02F 3/7677; E02F 3/7672; E02F 3/7622; E02F 3/8155; E02F 3/844; E02F 3/8152; E02F 3/765
See application file for complete search history.

(56) References Cited

U.S. PATENT DOCUMENTS 3,515,221 A * 6/1970 Fowler ..... A01B 63/10 172/445.2
4,061,194 A * 12/1977 McCanse ..... E02F 3/844 172/260.5
4,337,833 A * 7/1982 Welch ..... E02F 3/7631 172/445.1
5,732,781 A * 3/1998 Chambers ..... E02F 3/627 172/825
5,938,399 A * 8/1999 Knutson ..... E02F 3/3681 37/468
6,168,348 B1 * 1/2001 Meyer ..... E02F 3/7663 404/90
6,360,459 B1 * 3/2002 Brookhart ..... E02F 3/345 37/234

(Continued)

OTHER PUBLICATIONS

Sharp Grade "Box Blade" brochure (2020)(2 pages).

(Continued)

*Primary Examiner* — Jamie L Mcgowan
(74) *Attorney, Agent, or Firm* — Lucian Wayne Beavers; Patterson Intellectual Property Law, PC

(57) ABSTRACT

A box blade grading attachment of the present disclosure may comprise an attachment frame, a coupler bracket, a tilt connection, a pivot beam, left and right caster wheels, a grading box, and a tilting actuator. The attachment frame includes a rear attachment frame portion for coupling of the box blade grading attachment to a construction machine and an upper attachment frame portion having an upward facing reference surface. The tilt connection defines a tilt axis about which the attachment frame may tilt relative to the coupler bracket. The tilt axis may be substantially parallel to the upward facing reference surface. The pivot beam is pivotally connected to the upper attachment frame portion and includes left and right caster wheels pivotally connected to the pivot beam. The tilting actuator tilts the attachment frame and the grading box about the tilt axis relative to the coupler bracket.

18 Claims, 8 Drawing Sheets

(56) References Cited

U.S. PATENT DOCUMENTS

| | | | | |
|---|---|---|---|---|
| 6,672,401 | B1 * | 1/2004 | Crowley, II | A01B 31/00 172/825 |
| 7,021,398 | B1 * | 4/2006 | Marshall | E02F 3/34 172/830 |
| 10,323,382 | B2 | 6/2019 | Sharp | |
| 10,676,894 | B2 | 6/2020 | Sharp | |
| 11,047,106 | B2 * | 6/2021 | Babl | E02F 3/42 |
| 11,236,484 | B2 | 2/2022 | Sharp | |
| 11,286,641 | B2 | 3/2022 | Mahrenholz et al. | |
| 11,913,191 | B2 * | 2/2024 | Thiessen | E02F 3/3677 |
| 12,584,287 | B2 * | 3/2026 | Narayanan | E02F 3/764 |
| 2011/0297405 | A1 | 12/2011 | Fraley et al. | |
| 2019/0040600 | A1 | 2/2019 | Koevoets | |
| 2021/0372082 | A1 | 12/2021 | Merkt | |
| 2023/0122412 | A1 | 4/2023 | Sharp | |
| 2025/0146251 | A1 * | 5/2025 | Kraft | E02F 3/844 |

OTHER PUBLICATIONS

Level Best "Box or Blade" brochure (undated but admitted to be prior art)(2 pages).
Level Best "PD Series Precision Box Grader" brochure (undated but admitted to be prior art)(2 pages).
Level Best Parts Manual (Apr. 16, 2018)(31 pages).
John Deere "Compact Construction Equipment Attachments" (Aug. 2022)(84 pages).

* cited by examiner

BOX BLADE

FIELD OF THE DISCLOSURE

The present disclosure relates to box blade grading attachments for construction machines including but not limited to skid steer loaders.

BACKGROUND

Construction machines perform a variety of operations. In some instances, the machines are provided with a work tool to perform a desired function. FIG. 1 illustrates a conventional construction machine, namely a skid steer loader, generally designated by the number 10. Conventional construction machines 10 may include a linkage having left and right boom arms, generally designated by the number 12, pivotally supported from a machine frame. The left and right boom arms 12 may be pivotally connected to a work tool coupler 14. The linkage may further include left and right work tool actuators, generally designated by the number 16, mounted on the left and right boom arms 12, respectively. The left and right work tool actuators 16 may be pivotally connected to the work tool coupler 14 and operable to pivot (pitch) the work tool coupler 14 relative to the left and right boom arms 12.

One exemplary work tool, namely a box blade grading attachment 22, is generally known in the prior art. However, conventional box blade grading attachments 22 have several issues, including suffering from tilt errors. The box blade grading attachment 22 may include a grading box 24 supported by an attachment frame 30 and operable to engage the ground surface 21. The grading box 24 may include a front edge 26 and a rear edge 28. The box blade grading attachment 22 may include a coupler bracket 32 operable to attach the box blade grading attachment 22 to the work tool actuator 16 of the construction machine. The box blade grading attachment 22 may be actuated to tilt (roll left or right) the attachment frame 30 relative to the coupler bracket 32 about a tilt axis 34. The tilt axis 34 is oriented at a downward angle 35 of approximately 20 degrees to horizontal. When the attachment frame 30 is tilted about the tilt axis 34 relative to the coupler bracket 32, a tilt error occurs. Namely, when the attachment frame 30 is tilted about the tilt axis 34 relative to the coupler bracket 32, the front edges 26 of the grading box 24 fall out of alignment, with one of the front edges 26 experiencing more forward movement in a longitudinal direction 36 than the other front edge 26. Thus, one of the front edges 26 extends further forward than the other front edge 26 a distance 38. This tilt error may cause the front and rear cutting blades of the grading box 24 to perform poorly.

There is a need for an improved box blade grading attachment that does not suffer from tilt errors.

BRIEF SUMMARY

This Brief Summary is provided to introduce a selection of concepts in a simplified form that are further described below in the Detailed Description. This Brief Summary is not intended to identify key features or essential features of the claimed subject matter, nor is it intended to be used to limit the scope of the claimed subject matter.

One aspect in accordance with the embodiments disclosed herein is a box blade grading attachment for a construction machine. In one embodiment, the box blade grading attachment includes an attachment frame, a coupler bracket, a tilt connection, a pivot beam, left and right caster wheels, a grading box, a parallelogram linkage, a lifting actuator, and a tilting actuator. The attachment frame includes an upper attachment frame portion and a rear attachment frame portion. The upper attachment frame portion may have a frame length extending forward from the rear attachment frame portion. The upper attachment frame portion may have an upward facing reference surface extending along a majority of the frame length. The coupler bracket includes an attachment interface for coupling of the box blade grading attachment to the construction machine. The tilt connection may be positioned between the coupler bracket and the rear attachment frame portion. The tilt connection may define a tilt axis about which the attachment frame may tilt relative to the coupler bracket. The tilt axis may be substantially parallel to the upward facing reference surface. The pivot beam may extend transversely to the frame length and may be pivotally connected to the upper attachment frame portion such that the pivot beam pivot axis is pivotable about a pivot axis relative to the upper attachment frame portion. The left and right caster wheels may be pivotally connected to the pivot beam on opposite sides of the pivot beam pivot axis. Each of the caster wheels may be pivotable about an upwardly extending caster axis relative to the pivot beam. The grading box may extend transversely to the frame length. The parallelogram linkage may be connected between the grading box and the attachment frame. The lifting actuator may be arranged to raise and lower the parallelogram linkage and the grading box relative to the attachment frame. The tilting actuator may be connected between the attachment frame and the coupler bracket for tilting the attachment frame and the grading box about the tilt axis relative to the coupler bracket.

In other aspects of the disclosure, a method of setting up a box blade grading attachment for grading a ground surface comprises providing a box blade grading attachment including an attachment frame tiltably mounted on a coupler bracket such that a tilt axis is substantially parallel to a visually detectible upward facing reference surface of the attachment frame; engaging a coupler of a construction machine with the coupler bracket so that the construction machine may lift and lower the box blade grading attachment by lifting and lowering the coupler; resting a pair of front caster wheels of the box blade grading attachment on the ground surface; visually evaluating whether the upward facing surface of the attachment frame is parallel to the ground surface; and adjusting a height of each of the front caster wheels relative to the attachment frame to make the upward facing reference surface of the attachment frame closer to parallel to the ground surface.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
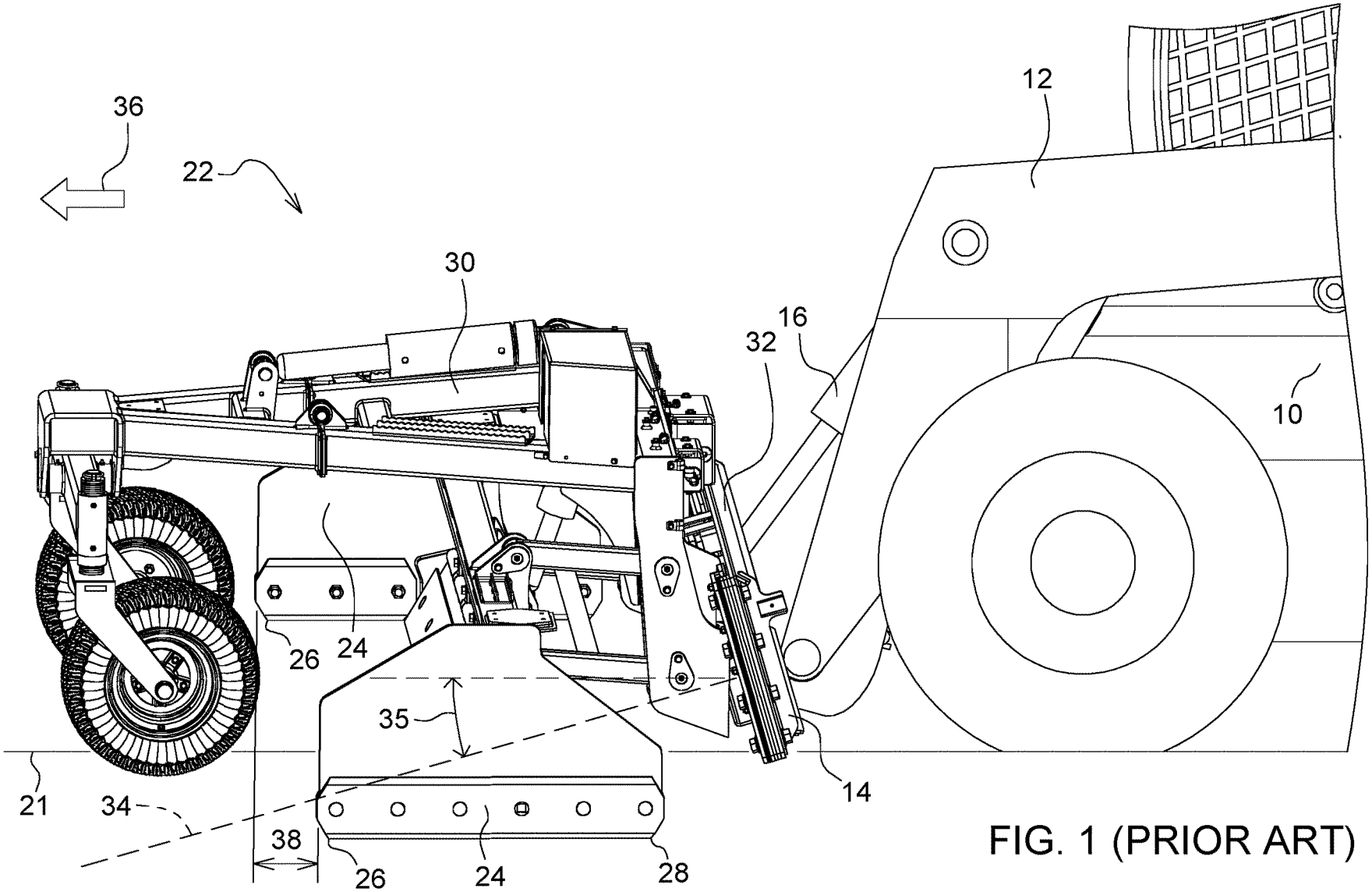
FIG. 1 (PRIOR ART)
FIG. 1 is a left side elevation view of a prior art box blade grading attachment coupled to a construction machine.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected," "attached," "joined," "mounted," "fastened," and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof. Furthermore, any part of the apparatus of the present disclosure may be made using any applicable manufacturing method, such as, but not limited to 3D printing, injection molding, or the like.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components.

The words "vertical" and "horizontal" are used for clarity of language to aid in understanding the disclosure. These words are in reference to orientations of the components when being viewed in an upright position and do not limit any of the claims to only the upright position. Vertical may, in some embodiments, be associated with an axis along the direction of gravity. Horizontal, then, may be associated with an axis that is perpendicular thereto. The terms substantially vertical and substantially horizontal may refer to a range that is about true vertical and true horizontal.

Figure 2:
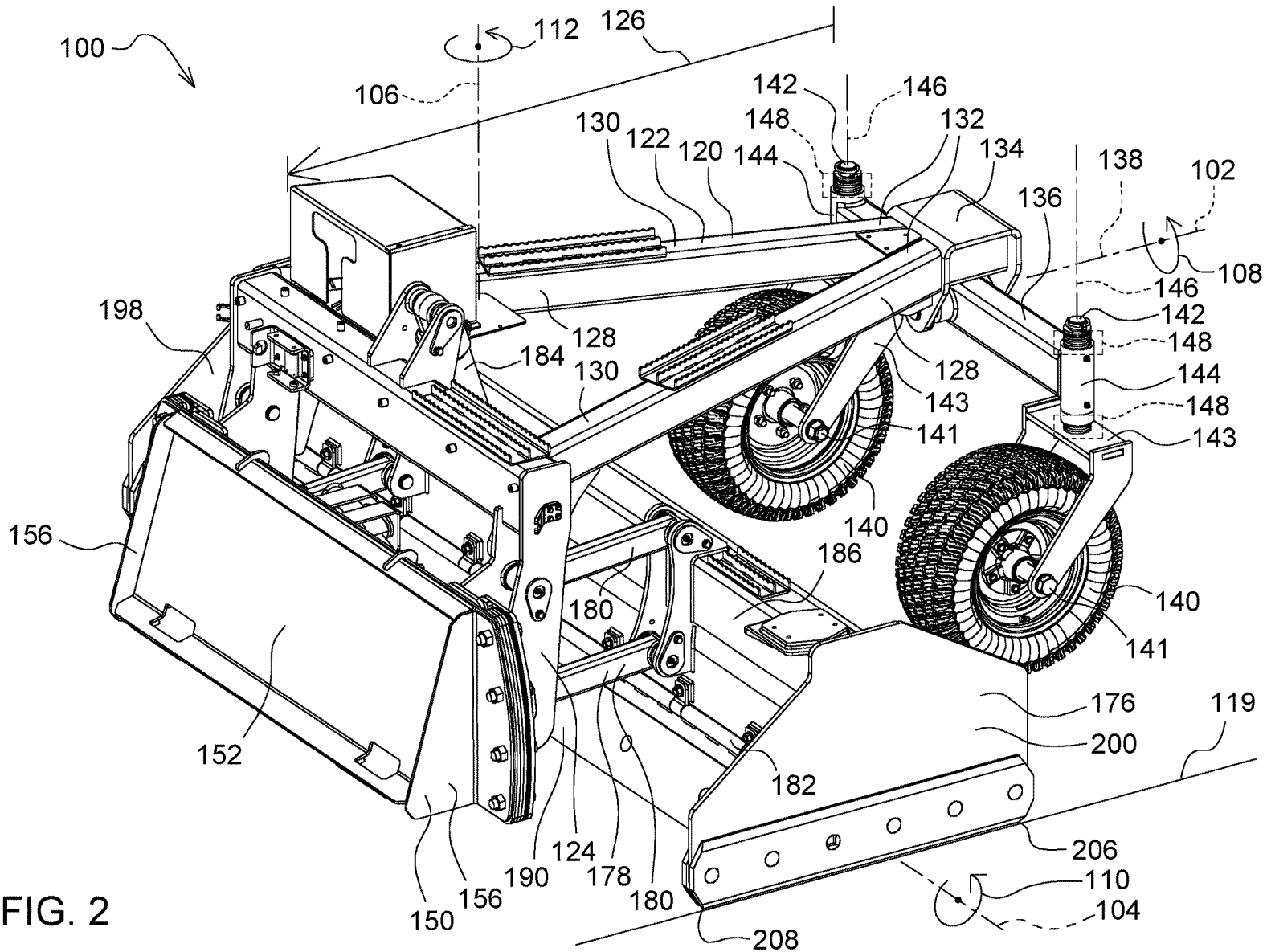
FIG. 2 is a right rear perspective view of a box blade grading attachment in accordance with the present disclosure.

Referring now to the drawings and particularly to FIGS. 2, a box blade grading attachment is shown and generally designated by the number 100. The box blade grading attachment 100 may be operable to selectively couple to a conventional construction machine 10, such as the skid steer loader shown in FIG. 1. The box blade grading attachment 100 may also be configured to selectively couple to other conventional construction machines 10, such as bulldozers, excavators, and motor graders to name a few examples.

The box blade grading attachment 100 may be operable to engage the ground and grade, cut, and/or move material to achieve simple or complex features on the ground. When attached to and operating with a construction machine 10, the box blade grading attachment 100 may experience movement in three directions and rotation in three directions. A direction of the box blade grading attachment 100 may also be referred to with regard to a longitudinal direction 102, a latitudinal or lateral direction 104, and a vertical direction 106. Rotation for the box blade grading attachment 100 may be referred to as roll 108 or the roll direction, pitch 110 or the pitch direction, and yaw 112 or the yaw direction or heading. The box blade grading attachment 100 may be hydraulically actuated to move vertically up and down ("lift"), roll left or right ("tilt"), and yaw left and right ("angle").

The terms "distal" and "proximal" may be used herein to describe certain features of the box blade grading attachment 100. The terms "distal" and "proximal" are used in relation to the point of view of an operator located on or within the construction machine 10. Thus, a proximal end of the box blade grading attachment 100 may be the end closest to the operator and the construction machine 10. A distal end of the box blade grading attachment 100 may be the end furthest from the operator and the construction machine 10.

Figure 6:
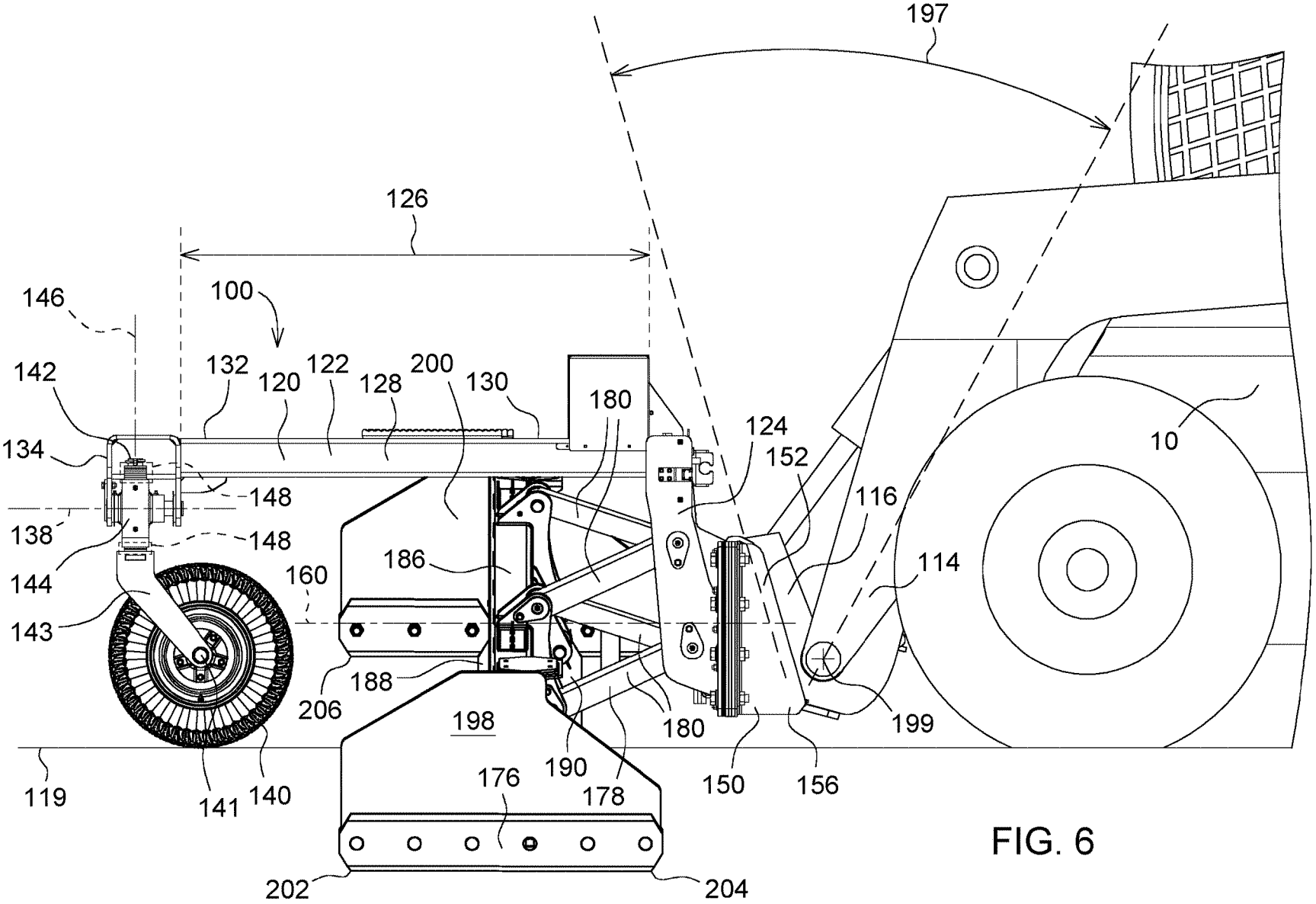
FIG. 6 is a left side elevation view of the box blade grading attachment of the present disclosure wherein the box blade grading attachment is coupled to a construction machine.

As shown in FIG. 6, the box blade grading attachment 100 may be movably connected to the construction machine 10 through a linkage 114 which supports and actuates the box blade grading attachment 100. Linkage 114 may include a work tool coupler 116 configured to engage and support a work tool, such as the box blade grading attachment 100. Linkage 114 may be configured to allow the box blade grading attachment 100 to be lifted (i.e., raised or lowered in the vertical direction 106) relative to a machine frame of the construction machine 10. Linkage 114 may also be configured pitch the box blade grading attachment 100 (i.e., pivot the box blade grading attachment 100 such that the distal end is raised or lowered in the vertical direction 106) relative to the linkage 114 of the construction machine 10.

Figure 3:
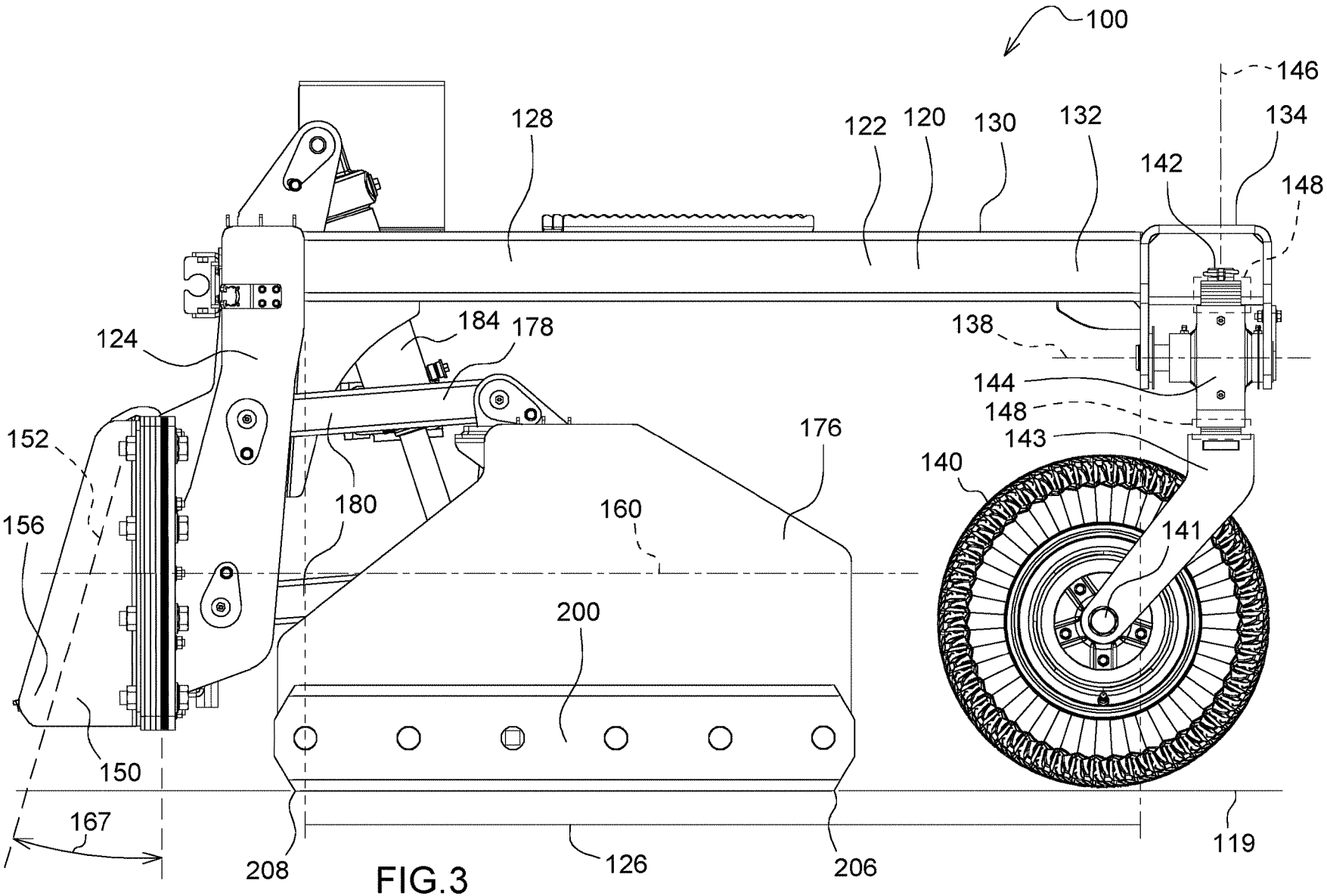
FIG. 3 is a right side elevation view of the box blade grading attachment of FIG. 2 in accordance with the present disclosure.

The box blade grading attachment 100 may include an attachment frame 120. The attachment frame 120 may include an upper attachment frame portion 122 and a rear attachment frame portion 124. As shown in FIG. 3, the upper attachment frame portion 122 may have a frame length 126 extending forward from the rear attachment frame portion 124. The upper attachment frame portion 122 may include left and right upper frame beams 128. The left and right upper frame beams 128 may be attached at one end to the rear attachment frame portion 124 and extend forward toward the distal end of the box blade grading attachment 100. The left and right upper frame beams 128 may converge toward each other as they extend forward. The left and right upper frame beams 128 may generally be arranged in a V-shape and have uniform lengths. The upper attachment frame portion 122 may have an upward facing reference surface 130 extending along a majority of the frame length 126. Each of the left and right upper frame beams 128 may have an upper surface defining a portion of the upward facing reference surface 130 of the upper attachment frame portion 122.

Referring now to FIG. 2, the left and right upper frame beams 128 each have a forward end 132 connected to a pivot beam mounting bracket 134. A pivot beam 136 is pivotally connected to the pivot beam mounting bracket 134 so as to pivot the pivot beam 136 about a pivot beam pivot axis 138 relative to the upper attachment frame portion 122. The pivot beam 136 may extend transversely to the frame length 126 of the attachment frame 120. The pivot beam mounting bracket 134 may be connected to the pivot beam 136 at a central portion of the pivot beam 136. The pivot beam pivot axis 138 may be parallel to the tilt axis 160 and parallel to the longitudinal axis 102.

Figure 7:
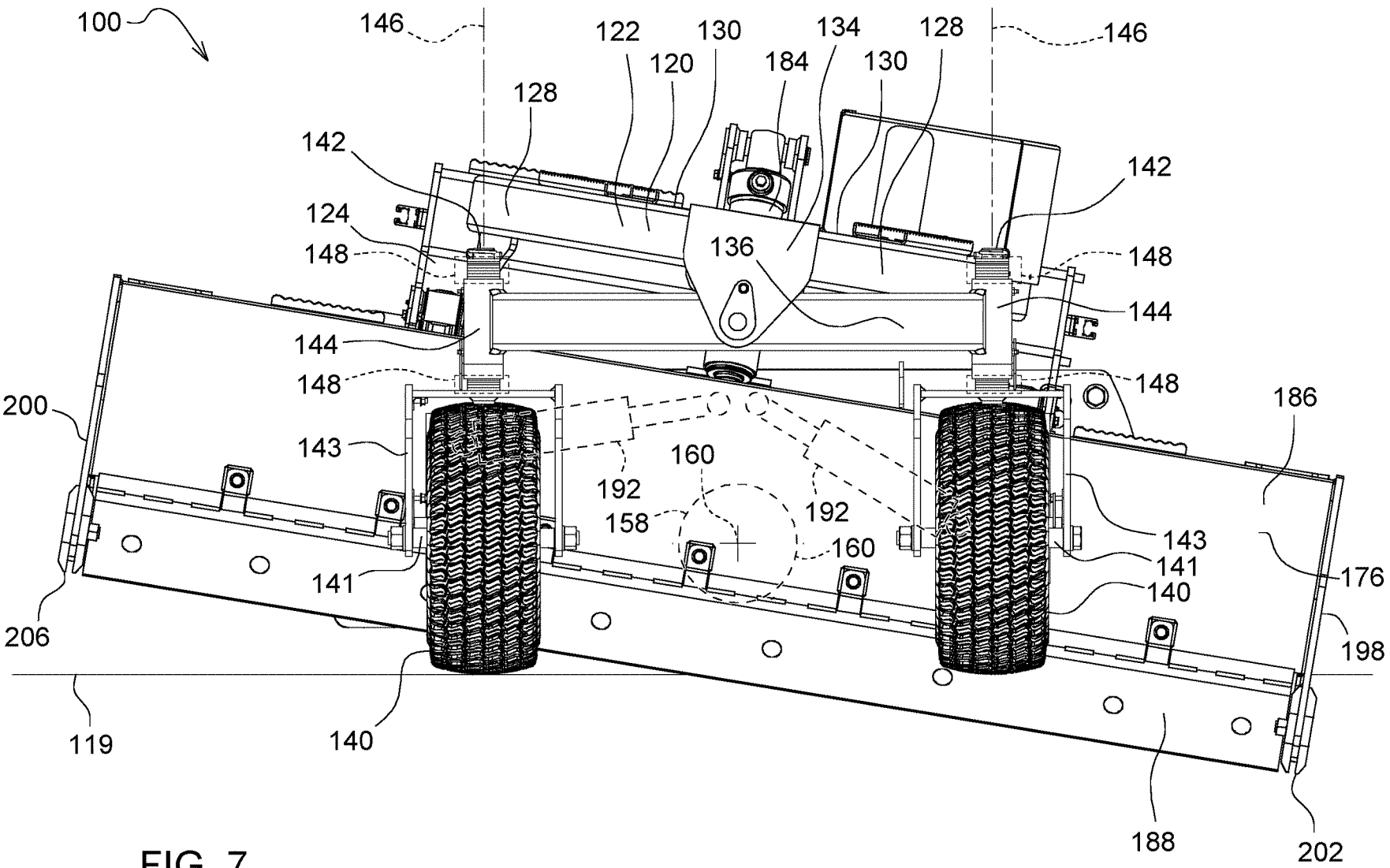
FIG. 7 is a front elevation view of the box blade grading attachment of FIG. 2 in accordance with the present disclosure wherein the grading box is tilted.
Figure 8:
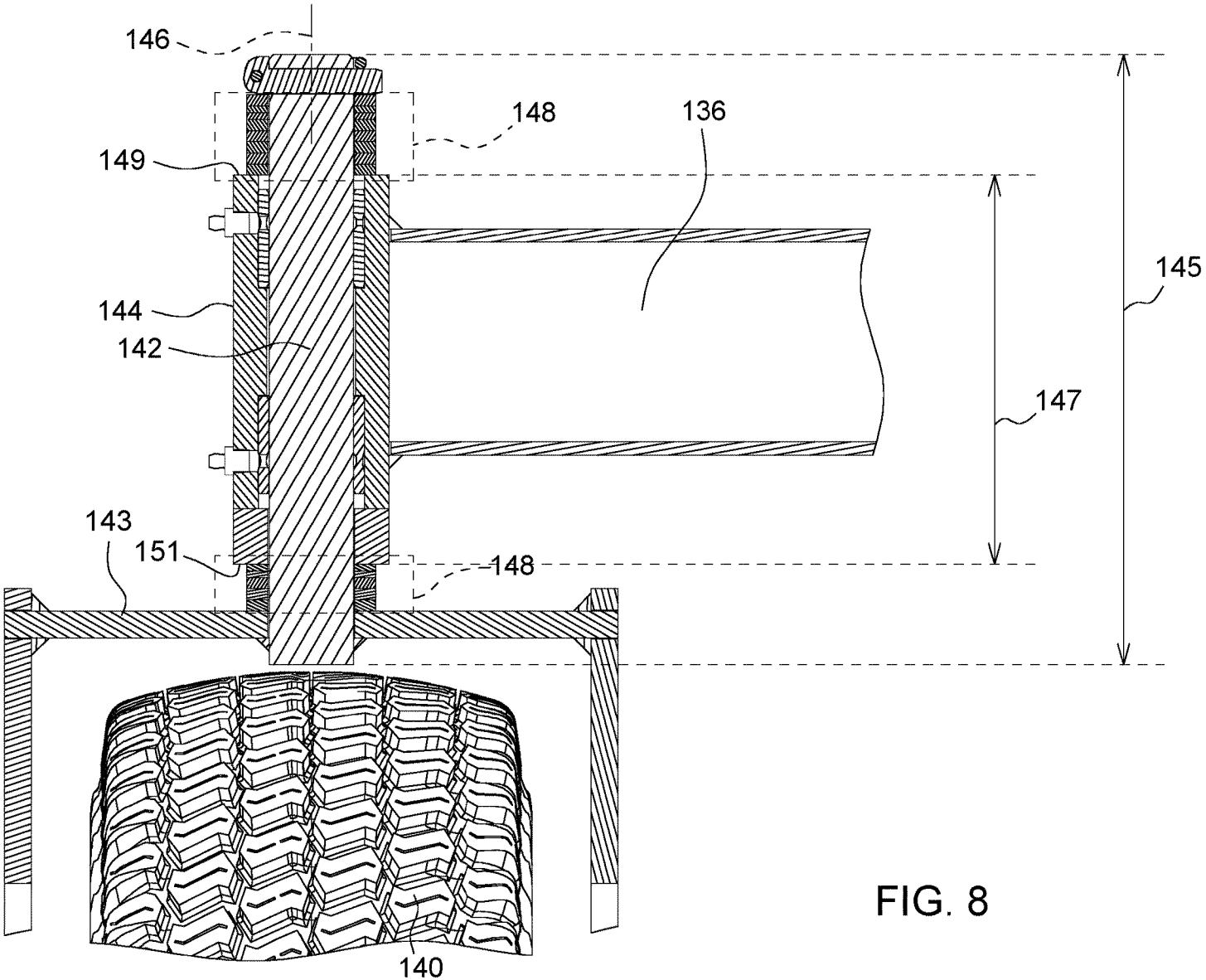
FIG. 8 is a sectioned elevation view of a portion of a pivot beam, caster wheel, caster axle, and caster journal of the box blade grading attachment of FIG. 2 in accordance with the present disclosure.

Referring to FIGS. 7-8, the box blade grading attachment 100 may include left and right caster wheels 140. One of skill in the art will appreciate that it is within the spirit and scope of the current disclosure to use other types of wheels in place of the left and right caster wheels 140. The left and right caster wheels 140 may also be referred to herein as a pair of front caster wheels 140. Each of the left and right caster wheels 140 may be pivotally connected to the pivot beam 136 on opposite sides of the pivot beam pivot axis 138. Each of the caster wheels 140 may be rotatably mounted on a yoke axle 141 such that the caster wheels 140 may roll over the ground surface 119. The yoke axle 141 may be mounted to a generally U-shaped mounting yoke 143. A caster axle 142 may extend up from the mounting yoke 143 and have a caster axle length 145. The caster axle 142 may be received in a caster journal 144 attached to the pivot beam 136. Thereby each of the caster wheels 140 are connected to the pivot beam 136. The caster journal 144 may include a caster journal length 147, an upper end 149, and a lower end 151. The caster axle length 145 of the caster axle 142 may be longer than the caster journal length 147 of the caster journal 144 so that the caster axle 142 extends out of each opposite end of the caster journal 144. Specifically, the caster axle 142 may extend out of the upper end 149 and the lower end 151 of the caster journal 144. The caster axle 142 may define a caster axis 146 extending upwardly. The caster axle 142 may be rotatably received in the caster journal 144 so each of the caster wheels 140 may pivot about the caster axis 146 relative to the pivot beam 136. Thus, the pivot beam 136 may pivot relative to the upper attachment frame portion 122 and each caster axle 142 may pivot relative to the pivot beam 136.

Referring now to FIG. 8, each of the left and right caster wheels 140 may be mounted on the pivot beam 136 so that the respective caster wheel 140 is height adjustable relative to the pivot beam 136 along the respective caster axis 146. Specifically, a plurality of adjustment washers 148 may be received about the caster axle 142 adjacent each end of the caster journal 144 so that the height of the caster wheel 140 may be adjusted by rearranging the plurality of adjustment washers 148. The caster wheels 140 may be height adjustable relative to the pivot beam 136 along the respective caster axis 146 by at least two (2) inches, and preferably by at least one (1) inch. Increasing the height of the caster wheel 140 may refer to increasing the distance between the caster wheel 140 and the pivot beam 136. Decreasing the height of the caster wheel 140 may refer to decreasing the distance between the caster wheel 140 and the pivot beam 136. For example, to increase the height of the caster wheel 140, a desired number of adjustment washers 148 may be added to the caster axle 142 below the caster journal 144. To decrease the height of the caster wheel 140, a desired number of adjustment washers 148 may be removed from the caster axle 142 below the caster journal 144. The left and right caster wheels 140 may be configured to operate at the same or different heights depending on the desired application.

The box blade grading attachment 100 may include a coupler bracket 150 attached to the rear attachment frame portion 124. The coupler bracket 150 may include an attachment interface 152 for coupling the box blade grading attachment 100 to the construction machine 10. Specifically, the attachment interface 152 may be operable to be engaged by the work tool coupler 116 of the construction machine 10. The coupler bracket 150 may include a tilt plate 154 extending transversely to the frame length 126 and positioned adjacent to and against the attachment interface 152. Left and right attachment end plates 156 may be fixed to opposite sides of the tilt plate 154. The left and right attachment end plates 156 may be operable to resist movement of the work tool coupler 14 of the construction machine 10 relative to the attachment interface 152. Specifically, the left and right attachment end plates 156 may be operable to resist lateral movement of the work tool coupler 116 of the construction machine 10 relative to the attachment interface 152.

Figure 4:
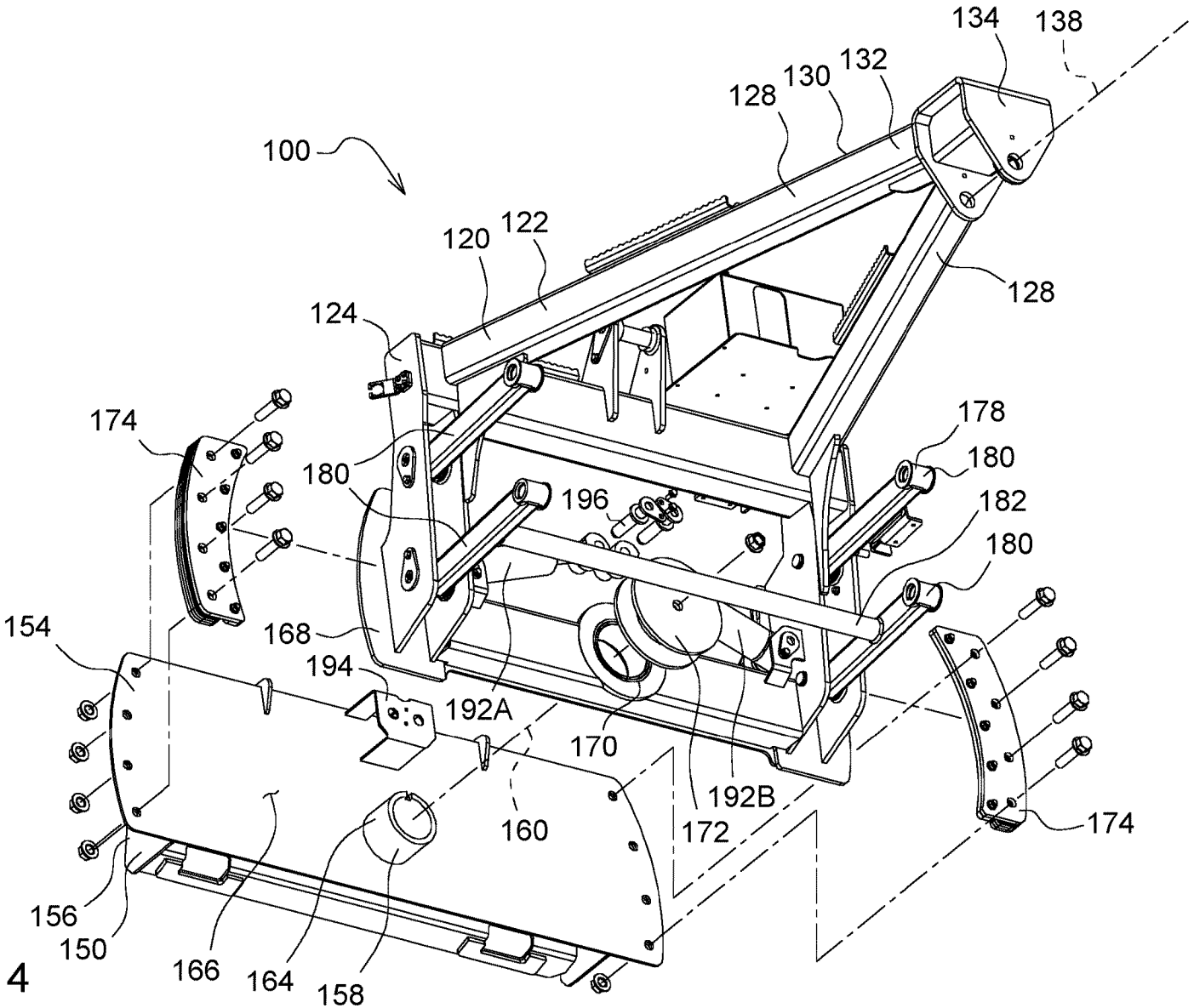
FIG. 4 is an exploded right front perspective view of the box blade grading attachment of FIG. 2 in accordance with the present disclosure wherein at least a grading box and pivot beam are removed.
Figure 5:
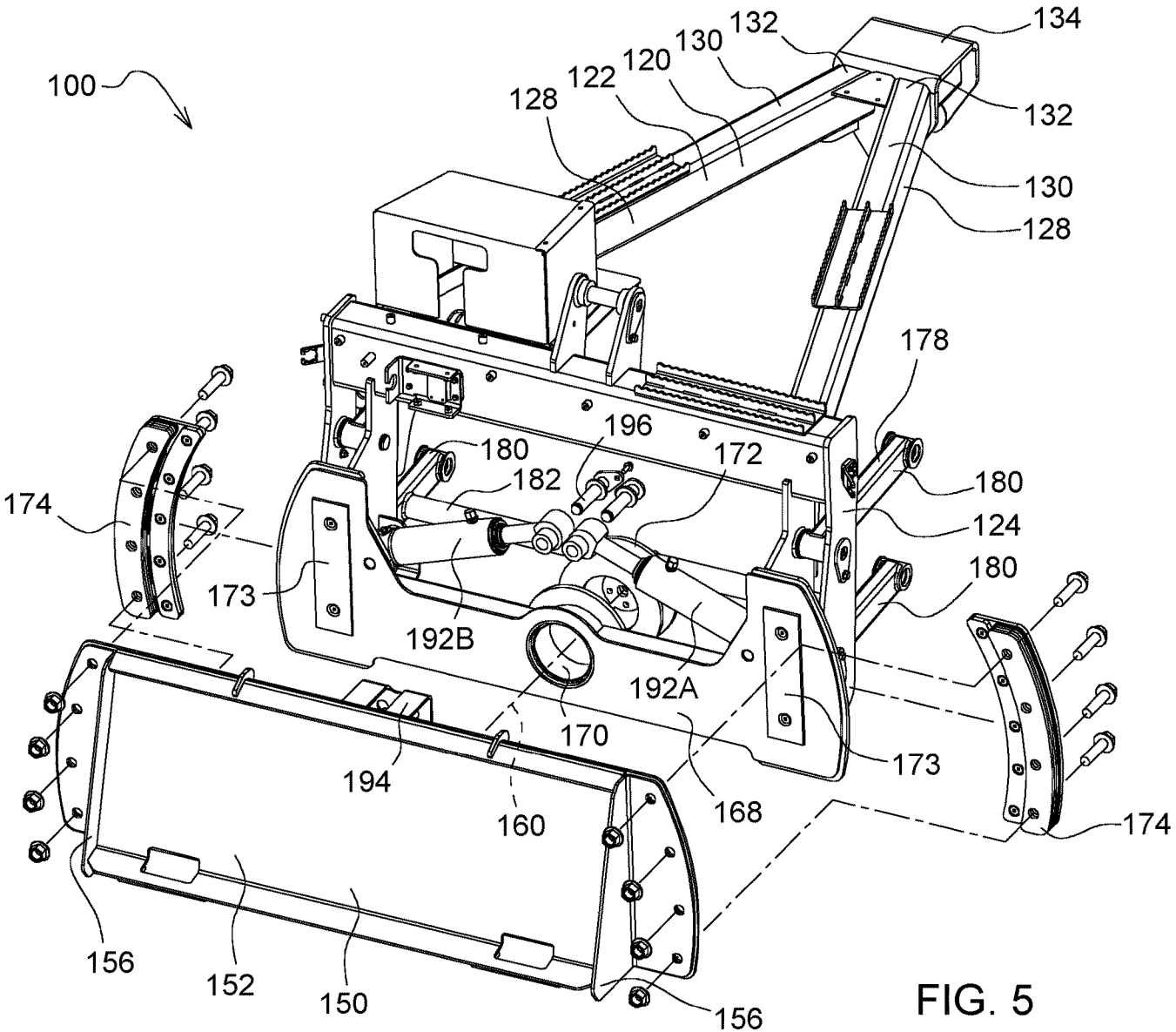
FIG. 5 is an exploded rear right perspective view of the box blade grading attachment of FIG. 2 in accordance with the present disclosure wherein at least the grading box and pivot beam are removed.

Referring now to FIGS. 4-5, the box blade grading attachment 100 may include a tilt connection 158 between the coupler bracket 150 and the rear attachment frame portion 124. The tilt connection 158 may define a tilt axis 160 about which the attachment frame 120 may tilt (rotate) relative to the coupler bracket 150. The tilt connection 158 may include a tilt hub 164 extending distally from the tilt plate 154 along the tilt axis 160. The tilt axis 160 may be substantially parallel to the upward facing reference surface 130 of the upper attachment frame portion 122. The term "substantially parallel" may refer to an orientation in which the tilt axis 160 is truly parallel to the upward facing reference surface 130. Further, "substantially parallel" should be understood to include an orientation in which the tilt axis 160 is plus or minus two (2) degrees of parallel, and preferably plus or minus one (1) degree of parallel to the upward facing reference surface 130.

The tilt plate 154 of the coupler bracket 150 may include a tilt plane surface 166 lying on the tilt plate 154 and oriented perpendicular to the tilt axis 160. The tilt plane surface 166 may also be oriented perpendicular to the upward facing reference surface 130 of the attachment frame 120. As shown in FIG. 3, the coupler bracket 150 may define a mounting angle 167 between the attachment interface 152 and the tilt plane surface 166 in a range of from about 10 to about 20 degrees. Specifically, the mounting angle 167 may be in a range of from 6 degrees to 24 degrees, preferably from 8 degrees to 22 degrees, and most preferably from 10 degrees to 20 degrees. The rear attachment frame portion 124 may include at least one tilt plane follower plate 168. The at least one tilt plane follower plate 168 may have a hole 170 defined therein and operable to receive the tilt hub 164. The hole 170 may be defined in a central portion of the at least one tilt plane follower plate 168. The tilt hub 164 may extend through the hole 170 of the at least one tilt plane follower plate 168 and be coupled to a hub cap 172. The at least one tilt plane follower plate 168, and thus the attachment frame 120, may rotate about the tilt hub 164. As shown in FIG. 5, one or more slide plates 173 may be mounted to the at least one tilt plane follower plate 168. The one or more slide plates 173 may include a low-friction material, such as nylon or graphite to name a few examples. The one or more slide plates 173 may be operable to reduce friction between the at least one tilt plane follower plate 168 and the tilt plane surface 166 when the attachment frame 120 is tilted relative to the coupler bracket 150. Thus, the one or more slide plates 173 may act as a buffer and reduce wear of the at least one tilt plane follower plate 168 and the tilt plane surface 166 of the tilt plate 154.

The box blade grading attachment 100 may include left and right capture plates 174. The left and right capture plates 174 may be attached to opposite ends of the tilt plate 154. Each of the left and right capture plates 174 may overlap the at least one tilt plane follower plate 168 so that the at least one tilt plane follower plate 168 is held against the tilt plane surface 166 of the tilt plate 154. The left and right capture plates 174 slidably engage the at least one tilt plane follower plate 168 so that the at least one tilt plane follower plate 168 may rotate about the tilt hub 164. The left and right capture plates 174 may prevent the at least one tilt plane follower plate 168 from separating from the tilt plate 154.

The box blade grading attachment 100 further includes a grading box 176 extending transversely to the frame length 126. A parallelogram linkage 178 may connect the grading box 176 to the attachment frame 120. The grading box 176 may be supported by the attachment frame 120 via the parallelogram linkage 178. The parallelogram linkage 178 may include a plurality of linkage members 180. Each linkage member 180 may be pivotally connected at one end to the attachment frame 120 and pivotally connected at an opposite end to the grading box 176. A lifting bar 182 may extend between a pair of the plurality of linkage members 180. A lifting actuator 184 may be arranged to raise and lower the parallelogram linkage 178, and thus the grading box 176, relative to the attachment frame 120. Specifically, the lifting actuator 184 may be pivotally connected at one end to the attachment frame 120 and pivotally connected at an opposite end to the lifting bar 182.

The grading box 176 may include a box frame 186 providing structural support to the grading box 176. The grading box 176 may include a front cutting blade 188 and a rear cutting blade 190 received in the box frame 186. The front and rear cutting blades 188, 190 may also be referred to herein as front and rear blades 188, 190. The front cutting blade 188 may be angled so that a bottom portion of the front cutting blade 188 is angled towards the distal end of the box blade grading attachment 100. The rear cutting blade 190 may be angled so that a bottom portion of the rear cutting blade 190 is angled towards the proximal end of the box blade grading attachment 100. Each of the front and rear cutting blades 188, 190 may be operable to engage and grade, cut, or move material. The front cutting blade 188 may be operable to engage the ground surface 119 when the construction machine 10 is pushing the box blade grading attachment 100 in a forward direction. The rear cutting blade 190 may be operable to engage the ground surface 119 when the construction machine 10 is pulling the box blade grading attachment 100 in a backwards direction.

The box blade grading attachment 100 may include at least one tilting actuator 192 for tilting the attachment frame 120 and the grading box 176 about the tilt axis 160 relative to the coupler bracket 150. The at least one tilting actuator 192 may be connected between the attachment frame 120 and the coupler bracket 150. The tilt plate 154 includes an actuator attachment bracket 194 extending from the tilt plane surface 166 in the distal direction. An end of the at least one tilting actuator 192 may be pivotally connected to the actuator attachment bracket 194 and an opposite end of the at least one tilting actuator 192 may be pivotally connected to the attachment frame 120, specifically the rear attachment frame portion 124. In the illustrated embodiment, the box blade grading attachment 100 includes two tilting actuators 192. A first of the at least one tilting actuator 192A and a second of the at least one tilting actuator 192B are pivotally connected to opposite sides of the attachment frame 120. A pin assembly 196 may pivotally connect the first and second of the at least one tilting actuators 192A, 192B to the actuator attachment bracket 194.

The upward facing reference surface 130 extends along a majority of the frame length 126 and may serve as a visual reference to operators. The tilt axis 160 may be substantially parallel to the upward facing reference surface 130. An operator may wish to place the tilt axis 160 parallel to the ground, but may find it difficult to visually see the tilt connection 158 and picture the tilt axis 160. Instead, the operator may position the upward facing reference surface 130, which is easily seen by the operator, parallel to the ground surface 119. Thereby, the operator may position the tilt axis 160 parallel to the ground surface. The substantially parallel orientation of the tilt axis 160 relative to the upward facing reference surface 130 allows the tilt axis 160 to be substantially parallel to the ground surface 119 when the upward facing reference surface 130 of the attachment frame 120 is substantially parallel to the ground surface 119.

Referring now to FIG. 6, the attachment interface 152 of the coupler bracket 150 may be configured such that when the caster wheels 140 are resting on the horizontal ground surface 119 with the upward facing reference surface 130 of the upper attachment frame portion 122 oriented parallel to the ground surface 119, the construction machine 10 can pitch the box blade grading attachment 100 through a rollback angle 197 of at least 45 degrees about a horizontal pitch axis 199. The horizontal pitch axis 199 may extend perpendicular to the tilt axis 160.

One advantage of the box blade grading attachment 100 disclosed herein may be that tilt induced errors are reduced. The box frame 186 may include a left side 198 and a right side 200 positioned generally parallel to one another. The left side 198 may include a front edge 202 and rear edge 204, and the right side 200 may include a front edge 206 and a rear edge 208. The left and right sides 198, 200 may extend parallel to the tilt axis 160. When the attachment frame 120 and the grading box 176 are tilted about the tilt axis 160 relative to the coupler bracket 150, neither the front edge 202 of the left side 198 or the front edge 206 of the right side 200 extends any further in the longitudinal direction 102 than the other. In other words, neither the front edge 202 of the left side 198 or the front edge 206 of the right side 200 experiences forward or backward movement when the attachment frame 120 and the grading box 176 are tilted about the tilt axis 160 relative to the coupler bracket 150. Moreover, when the attachment frame 120 and the grading box 176 are tilted about the tilt axis 160 relative to the coupler bracket 150, the left side 198 and the right side 200 of the box frame 186 remain parallel to the ground surface 119. Thus, the height of the front edge 202 of the left side 198 is the same as the height of the rear edge 204 of the left side 198 and the height of the front edge 206 of the right side 200 is the same as the height of the rear edge 208 of the right side 200.

Another aspect of the present disclosure is a method of setting up the box blade grading attachment 100 for grading the ground surface 119. The method comprises providing the box blade grading attachment 100 disclosed herein. The box blade grading attachment 100 includes the attachment frame 120 tiltably mounted on the coupler bracket 150 such that the tilt axis 160 is substantially parallel to the visually detectible upward facing reference surface 130 of the attachment frame 120.

The method further comprises engaging the work tool coupler 116 of the construction machine 10 with the coupler bracket 150 so that the construction machine 10 may lift and lower the box blade grading attachment 100 by lifting and lowering the work tool coupler 116. Specifically, the work tool coupler 116 may engage the attachment interface 152 of the coupler bracket 150.

The method further comprises resting the pair of front caster wheels 140 of the box blade grading attachment 100 on the ground surface 119. As provided previously, the pair of front caster wheels 140 may be pivotally connected to the pivot beam 136 on opposite sides of the pivot beam pivot axis 138. The caster wheels 140 may be connected to the pivot beam 136 with the caster axle 142 received in the caster journal 144. The caster axle 142 may define the caster axis 146. The plurality of adjustment washers 148 may be received about the caster axle 142 adjacent each end of the caster journal 144 so that the height of the caster wheel 140 may be adjusted by rearranging the adjustment washers 148.

The method further comprises visually evaluating whether the upward facing reference surface 130 of the attachment frame 120 is parallel to the ground surface 119. The operator may perform this step from an operator cab of the construction machine 10 or may alternatively perform this step standing apart from the construction machine 10. The tilt axis 160 may be substantially parallel to the upward facing reference surface 130. Thus, by evaluating the orientation of the upward facing reference surface 130 relative to the ground surface 119, the operator may also evaluate the orientation of the tilt axis 160 relative to the ground surface 119.

The method further comprises adjusting the height of each of the front caster wheels 140 relative to the attachment frame 120 to make the upward facing reference surface 130 of the attachment frame 120 closer to parallel to the ground surface 119. The adjust step disclosed herein may further include adjusting a number of adjustment washers 148 between the caster axle 142 and ends of the caster journal 144 of each of the caster wheels 140. For example, to increase the height of the caster wheel 140, a desired number of adjustment washers 148 may be added to the caster axle 142 below the caster journal 144. Increasing the height of the caster wheel 140 may refer to increasing the distance between the caster wheel 140 and the pivot beam 136. To decrease the height of the caster wheel 140, a desired number of adjustment washers 148 may be removed from the caster axle 142 below the caster journal 144. Decreasing the height of the caster wheel 140 may refer to decreasing the distance between the caster wheel 140 and the pivot beam 136.

The adjusting step disclosed herein may result in the tilt axis 160 being closer to parallel to the ground surface 119. Thereby any tilt induced errors that would otherwise result in the front and rear blades 188, 190 of the box blade grading attachment 100 being at different heights relative to the ground surface 119 when the attachment frame 120 is tilted about the tilt axis 160 are reduced.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A box blade grading attachment for a construction machine, comprising:

an attachment frame including an upper attachment frame portion and a rear attachment frame portion, the upper attachment frame portion having a frame length extending forward from the rear attachment frame portion, the upper attachment frame portion having an upward facing reference surface extending along a majority of the frame length;

a coupler bracket including an attachment interface for coupling of the box blade grading attachment to the construction machine;

a tilt connection between the coupler bracket and the rear attachment frame portion, the tilt connection defining a tilt axis about which the attachment frame may tilt relative to the coupler bracket, the tilt axis being substantially parallel to the upward facing reference surface;

a pivot beam extending transversely to the frame length and pivotally connected to the upper attachment frame portion such that the pivot beam is pivotable about a pivot beam pivot axis relative to the upper attachment frame portion;

left and right caster wheels pivotally connected to the pivot beam on opposite sides of the pivot beam pivot axis, each of the caster wheels being pivotable about an upwardly extending caster axis relative to the pivot beam;

a grading box extending transversely to the frame length;

a parallelogram linkage connected between the grading box and the attachment frame;

at least one lifting actuator arranged to raise and lower the parallelogram linkage and the grading box relative to the attachment frame; and at least one tilting actuator connected between the attachment frame and the coupler bracket for tilting the attachment frame and the grading box about the tilt axis relative to the coupler bracket.

2. The box blade grading attachment of claim 1, wherein:
each of the caster wheels is mounted on the pivot beam so that the respective caster wheel is height adjustable relative to the pivot beam along the respective caster axis.

3. The box blade grading attachment of claim 2, wherein:
each of the caster wheels is connected to the pivot beam with a caster axle received in a caster journal, the caster axle defining the caster axis, the caster axle being longer than the caster journal so that the caster axle extends out of each opposite end of the caster journal, and a plurality of adjustment washers are received about the caster axle adjacent each end of the caster journal so that the height of the caster wheel may be adjusted by rearranging the adjustment washers.

4. The box blade grading attachment of claim 2, wherein:
each of the caster wheels is height adjustable by at least one inch relative to the pivot beam along the respective caster axis.

5. The box blade grading attachment of claim 2, wherein:
each of the caster wheels is height adjustable by at least two inches relative to the pivot beam along the respective caster axis.

6. The box blade grading attachment of claim 1, wherein:
the grading box includes a box frame and front and rear cutting blades received in the box frame; and
the substantially parallel orientation of the tilt axis relative to the upward facing reference surface allows the tilt axis to be substantially parallel to a ground surface when the top plane of the attachment frame is substantially parallel to the ground surface, thereby reducing any tilt induced error that would otherwise result in the front and rear cutting blades being at different heights relative to the ground surface.

7. The box blade grading attachment of claim 1, wherein:
the pivot beam pivot axis is substantially parallel to the tilt axis.

8. The box blade grading attachment of claim 1, wherein:
the coupler bracket Includes a tilt plane surface extending substantially normal to the tilt axis; and
the rear attachment frame portion includes at least one tilt plane follower plate slidably engaging the tilt plane surface so that the at least one follower plate slides on the tilt plane surface when the attachment frame is tilted relative to the coupler bracket.

9. The box blade grading attachment of claim 8, wherein:
the coupler bracket defines a mounting angle between the attachment interface and the tilt plane surface in a range of from about 10 to about 20 degrees.

10. The box blade grading attachment of claim 9 in combination with the construction machine coupled to the attachment interface, wherein:
the attachment interface is configured such that when the caster wheels are resting on a horizontal ground surface with the upward facing reference surface of the upper attachment frame portion oriented parallel to the ground surface, the construction machine can pitch the box blade grading attachment through a roll back angle of at least 45 degrees about a horizontal pitch axis perpendicular to the tilt axis.

11. The box blade grading attachment of claim 8, wherein:
the tilt plane surface is substantially perpendicular to the upward facing reference surface of the attachment frame.

12. The box blade grading attachment of claim 1, wherein:
the upper attachment frame portion includes left and right upper frame beams attached at one end to the rear attachment frame portion and extending forward, the left and right upper frame beams converging toward each other as they extend forward, each of the left and right upper frame beams having an upper surface defining a portion of the upward facing reference surface of the upper attachment frame portion.

13. The box blade grading attachment of claim 12, wherein:
the left and right upper frame beams each have a forward end connected to a pivot beam mounting bracket; and
the pivot beam is pivotally connected to the pivot beam mounting bracket so as to pivot about the pivot beam pivot axis.

14. The box blade grading attachment of claim 1, wherein:
the tilt axis is plus or minus 2 degrees from parallel to the upward facing reference surface of the attachment frame.

15. The box blade grading attachment of claim 1, wherein:
the tilt axis is plus or minus 1 degree from parallel to the upward facing reference surface of the attachment frame.

16. A method of setting up a box blade grading attachment for grading of a ground surface, comprising:
providing a box blade grading attachment including an attachment frame tiltably mounted on a coupler bracket such that a tilt axis is substantially parallel to a visually detectible upward facing reference surface of the attachment frame;
engaging a coupler of a construction machine with the coupler bracket so that the construction machine may lift and lower the box blade grading attachment by lifting and lowering the coupler;
resting a pair of front caster wheels of the box blade grading attachment on the ground surface;
visually evaluating whether the upward facing reference surface of the attachment frame is parallel to the ground surface; and
adjusting a height of each of the front caster wheels relative to the attachment frame to make the upward facing reference surface of the attachment frame closer to parallel to the ground surface.

17. The method of claim 16, wherein:
the adjusting step includes adjusting a number of adjustment washers between a caster axle and ends of a caster journal of each of the caster wheels.

18. The method of claim 16, wherein:
the adjusting step results in the tilt axis also being closer to parallel to the ground surface, thereby reducing any tilt induced error that would otherwise result in front and rear blades of the box blade grading attachment being at different heights relative to the ground surface when the adjustment frame is tilted about the tilt axis.

* * * * *